US007695339B2

(12) United States Patent
Friedman et al.

(10) Patent No.: US 7,695,339 B2
(45) Date of Patent: Apr. 13, 2010

(54) TEETHING TOY

(76) Inventors: Mary Kathryn Friedman, 3720 Fillmore #204, San Francisco, CA (US) 94123; Larry P. LaPointe, 1066 Substation Rd., Temperance, MI (US) 48182; Candace M. LaPointe, 1066 Substation Rd., Temperance, MI (US) 48182; Richard Friedman, 3720 Fillmore #204, San Francisco, CA (US) 94123

( * ) Notice: Subject to any disclaimer, the term of this patent is extended or adjusted under 35 U.S.C. 154(b) by 208 days.

(21) Appl. No.: 11/986,048

(22) Filed: Nov. 21, 2007

(65) Prior Publication Data

US 2009/0130944 A1 May 21, 2009

(51) Int. Cl.
*A63H 33/00* (2006.01)

(52) U.S. Cl. ..... 446/227; 446/267; 446/73; 446/74; 446/77; 446/304; 248/102; 248/104

(58) Field of Classification Search ..... 446/227, 446/267, 73, 74, 77, 304; 248/102, 104
See application file for complete search history.

(56) References Cited

U.S. PATENT DOCUMENTS 3,071,888 A * 1/1963 Knott ..... 446/267
3,405,829 A * 10/1968 Siravo ..... 446/71
3,512,301 A * 5/1970 Kramer ..... 446/71
4,114,847 A * 9/1978 Bogensberger ..... 248/104
4,416,438 A * 11/1983 King ..... 248/102
4,723,801 A * 2/1988 Musumeci et al. ..... 248/102
4,869,381 A * 9/1989 Agner ..... 248/102
5,114,374 A * 5/1992 Estiva ..... 446/227
5,180,071 A * 1/1993 Crosson ..... 446/227
5,192,041 A * 3/1993 Bryant ..... 248/104
5,766,223 A 6/1998 Johnson
6,872,116 B1 * 3/2005 Dunnum et al. ..... 446/73
2005/0211855 A1 * 9/2005 Rayman ..... 248/105

* cited by examiner

*Primary Examiner*—Gene Kim
*Assistant Examiner*—Urszula M Cegielnik

(57) ABSTRACT

A teething toy that is chewable and sensory stimulating uses a hollow cylinder made of a soft clear polymeric material. It is approximately half filled with a colored fluid. Shiny particle specks and different shaped multicolored floating objects are suspended in the fluid. Nipple shaped protrusions extend from end spherical end. A circular handle with oval cross section extends from the side of the cylinder. Directly opposite this handle is a rectangular shaped handle with oval cross section. The sides of both handles have small extension knobs protruding from the narrow sides of the cross sections. Options include longitudinal ribs running along the cylinder surface for easy grasp and manipulation. Additional options include rectangular grips extending, from the sides of the toy. Options include a suction cup and suspended from a flexible plastic cord that tethers the toy to a surface such as a high chair tray.

29 Claims, 14 Drawing Sheets

TEETHING TOY

FIELD OF THE INVENTION

The present invention relates to teething toys and, more particularly, to a teething toy that provides a young child with multiple sensory stimulation paths and a memory response to feeding.

BACKGROUND OF THE INVENTION

In the first years of a young child's life, physical and cognitive growth occurs at a rapid rate. Sensory stimulation provides an ideal learning path with additional benefits of hand eye coordination, motor skills and physical enjoyment. Inadequate stimulus slows development and may cause irritability and dissatisfaction.

It is a fact of life in the 21st century to have two income households. With so many mothers in today's workforce, many children are bottle fed by parents and caregivers at day care centers. Children become accustomed to the shape of feeding bottles and retain a memory of enjoyment because of the sucking and hunger satisfaction. Most young children become accustomed to manipulating the feeding bottle themselves.

It has also been a fact of life since the dawn of mankind that young children have a need to chew on objects to lessen the discomfort of cutting teeth through their gums. The process is commonly referred to as "teething" and the objects used to chew on include fingers and anything else that is within reach. Human nature provides the young with a natural curiosity to grasp, look at, chew on and then discard objects, because they have lost interest in them. Then the process begins again. Many objects brought to the mouth for oral gratification could potentially harm the child because of sharp edges, swallowing potential or material content. Caregivers have sought safe and effective ways to provide a chewing surface with the advent of the teething toy.

Teething toys are generally configured of a soft material that a young child can chew on. However, because of generic shapes, lack of visual stimulation and lack of real satisfaction, interest in the toy is easily lost. There is not adequate sensory stimulation built into current teething toys to retain the interest of most young children or a memory response for retention of the toy. This results in throwing of the toy with eventual dissatisfaction of the child. An example of a representative teething toy is described in U.S. Pat. No. 5,766,223 issued to Johnson.

Prior art teething toys are inherently boring to a child. They do provide a chewing surface but lack an inherent interest, satisfaction or memory response. Heretofore, no toy has been developed that can orally satisfy the child, provide sensory stimulation and retain the child's interest for toy retention.

It is therefore an object of the invention to provide a chewable teething toy

It is another object of the invention to provide a teething toy with visual sensory stimulation It is further object of the invention to provide a teething toy that is familiar in size, shape and weight to a feeding bottle It is an object of the invention to provide a teething toy that is easy to chew on, suck on and manipulate near the mouth It is another object of the invention to provide a teething toy that stimulates a memory response to hunger suppression and oral stimulation It is a further object of the invention to provide a teething toy that remains interesting and orally gratifying to the child for toy retention

SUMMARY OF THE INVENTION

In accordance with the present invention, there is provided a teething toy that is chewable, sensory stimulating and familiar in shape and weight characteristics to a feeding bottle. A hollow, bottle shaped cylinder similar in size and weight to a partially filled feeding bottle has spherically closed ends with differing shaped protrusions emanating from each end of the cylinder. The material is a soft chewable clear plastic with benign material characteristics. The cylinder is approximately half filled with a colored liquid. Different shaped multicolored objects are floating in the liquid. One end of the cylinder has a nipple shaped protrusion that easily fits into the mouth. The opposite end has a multiple surface nipple shaped protrusion with slightly larger rings that easily fit into the mouth. A circular handle protrudes out of the side of the cylinder. The cross section of the circular handle is oval shaped. The sides of the circular handle have small cylindrical knobs protruding from the narrow sides of the oval cross section. Directly opposite the circular handle is a rectangular shaped handle. The cross section of the rectangular handle is oval shaped. The sides of the rectangular handle have small cylindrical knobs protruding from the narrow sides of the oval cross section. Options include having ribs run along the perimeter of the teething toy in the longitudinal direction traveling the length of the cylindrical surface for easy grasp and ease of manipulation. Additional options include having rectangular handles emanate from the sides of the perimeter of the cylindrical teething toy. Still other options include a suction cup end suspended from a flexible semi rigid plastic cord that tethers the teething toy to a convenient surface such as a high chair tray.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

In accordance with the teachings of the present invention, an improved teething toy 10 is disclosed. As will be described, teething toy 10 provides features that provide oral gratification to young children, assists the development and growth of teeth through the gum tissue and by its shape and mass characteristics retains the interest of the child for retention of teething toy 10.

Figure 1:
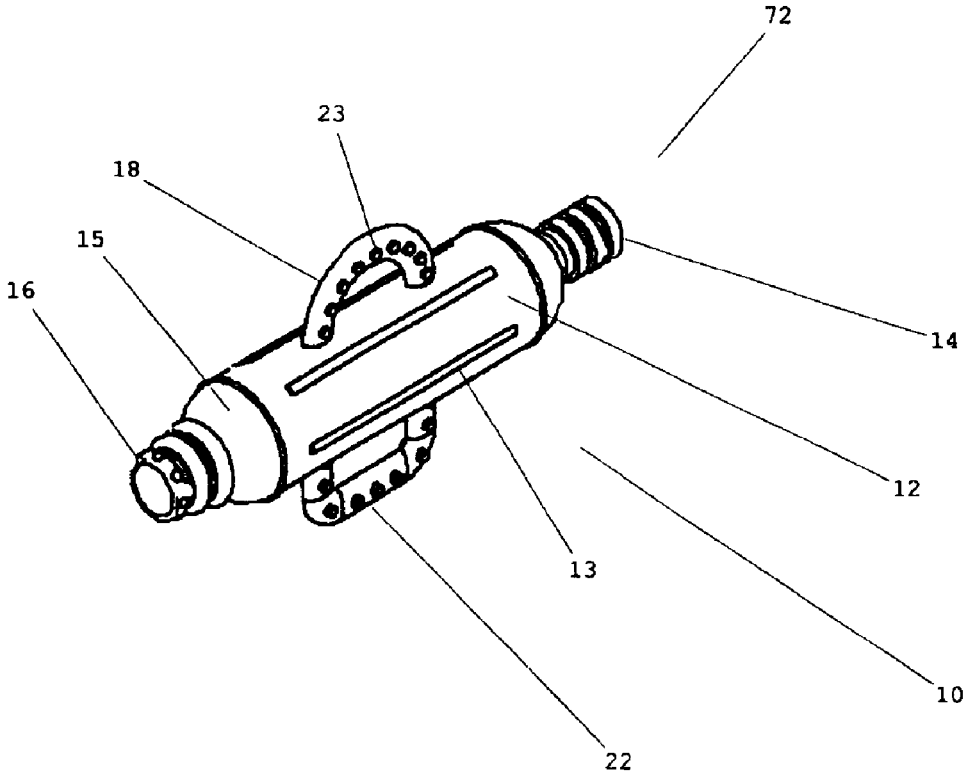
FIG. 1 is a perspective view of a teething toy of the present invention.
Figure 14:
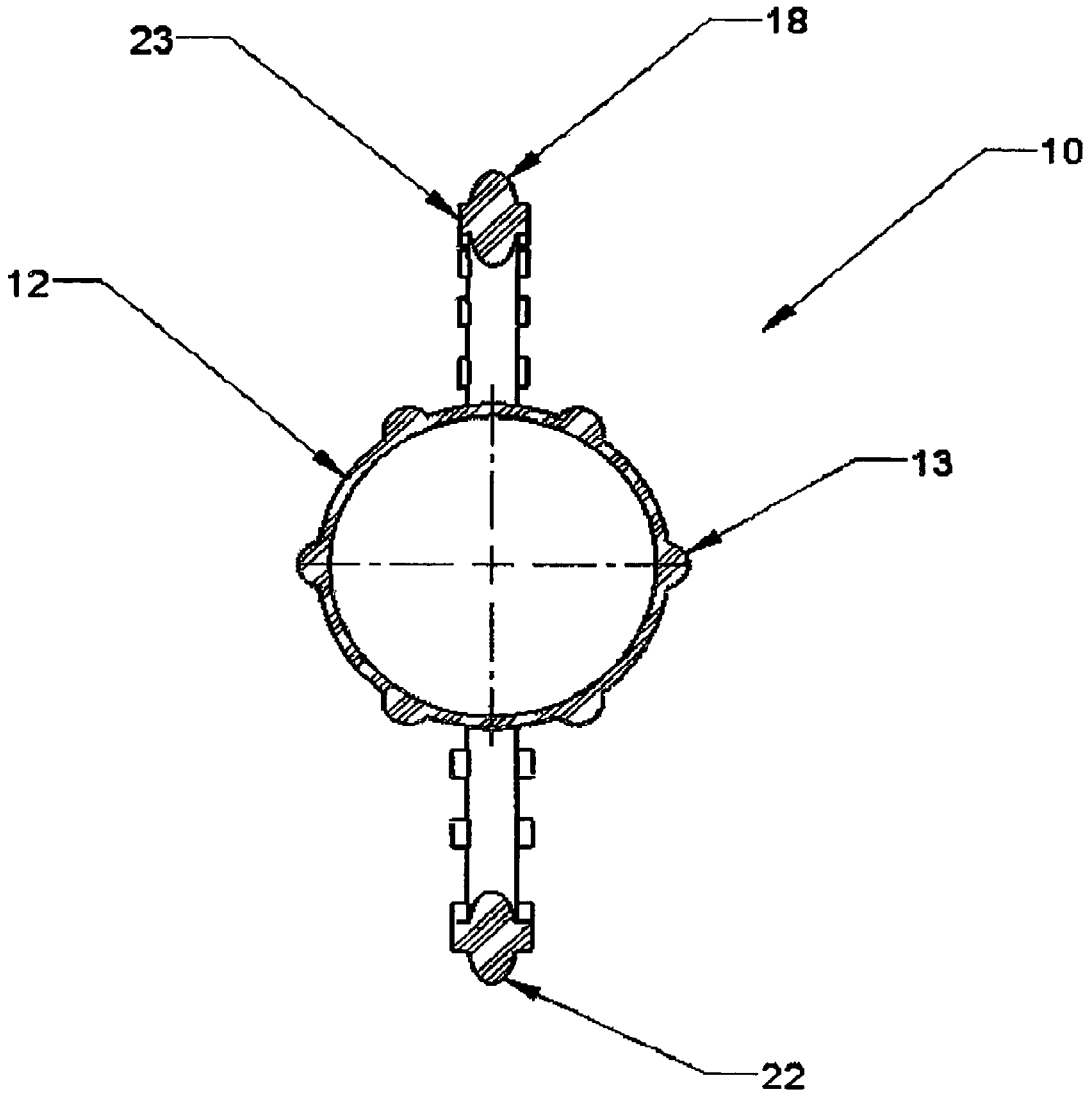
FIG. 14 is a sectional view of a teething toy of the present invention.

Referring to FIG. 1 and FIG. 14, the main body of teething toy 10 is made up of the cavity base 12. This component is a hollow cylinder and is similar in size and mass characteristics to a common infant feeding bottle. The material of cavity base 12 is a soft, flexible and clear polymeric material with benign material characteristics. One embodiment of teething toy 10 has rib 13 protrusions that run longitudinally along the perimeter of cavity base 12. The rib 13 protrusion provides a rounded gripping surface to aid the child in holding onto teething toy 10. The preferred embodiment has six rib 13 protrusions. However, alternate embodiments may have more or less rib 13 protrusions or no rib 13 protrusions at all. A circular ring handle 18 protrudes from the side of the cavity base 12. The circular ring handle 18 has an oval cross section with knobs that extend from the wide face of the cross-section. The shape of the knob 23 is circular and provides a grasping aid for the child to hold onto the circular ring handle of teething toy 10. A rectangular ring handle 22 also protrudes from the side of the cavity base 12. The rectangular ring handle 22 has an oval cross section with knobs that extend from the wide face of the cross-section. The preferred embodiment has a circular ring handle 18 that is 2½ inches in diameter with a ring width of ½ inch with a ring thickness of ¼ inch with the diameter of the knob 23 defined as ⅛ inch. The preferred embodiment has a rectangular ring handle 22 that is 2½ inches long by 1½ inches wide with a ring width of ½ inch and a ring thickness of ¼ inch with the diameter of the knob 23 defined as ⅛ inch. Each handle has nine knobs that protrude from each side. The preferred embodiment has the rectangular ring handle 22 positioned 180 degrees apart from the circular ring handle 18 and centered in relation to the cavity base 12. However, the size and location of the circular ring handle 18, rectangular ring handle 22, knob 23, number of knobs and positioning could be changed without detracting from the spirit or scope of the present invention.

Figure 6:
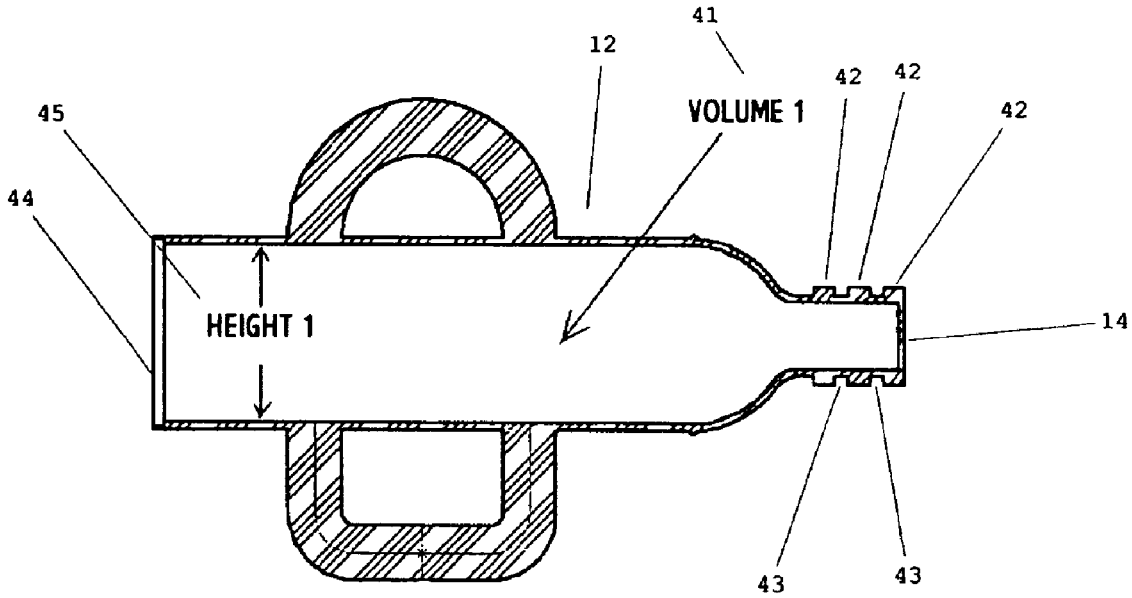
FIG. 6 is a right sectional view of a cavity base of the teething toy of FIG. 1.

One end of cavity base 12 has an integral closed shape that spherically terminates the cylinder of cavity base 12 into end ring major 14. This end of cavity base 12 has three concentric rings that are sized to fit easily in a small child's mouth. Referring to FIG. 6, the purpose of end ring major 14 is to provide a series of rings that provide a vertical edge ring 42 with a distinct edge to bite on. Separation of each vertical edge ring 42 is provided by a vertical edge groove 43. A preferable embodiment of cavity base 12 has three edge rings and two edge grooves. However, more or less rings and grooves could be substituted. The relative size difference between the vertical edge ring 42 and the vertical edge groove 43 is large enough to provide a space for a child's gum tissue or teeth to fit into. The preferred embodiment has Vertical edge rings that are ⅞ inches in diameter with a groove depth of 0.075 inch. However, rings that have a larger or smaller vertical edge ring 42 could be used with alternate size groove depths that define the diameter of vertical edge groove 43.

Figure 2:
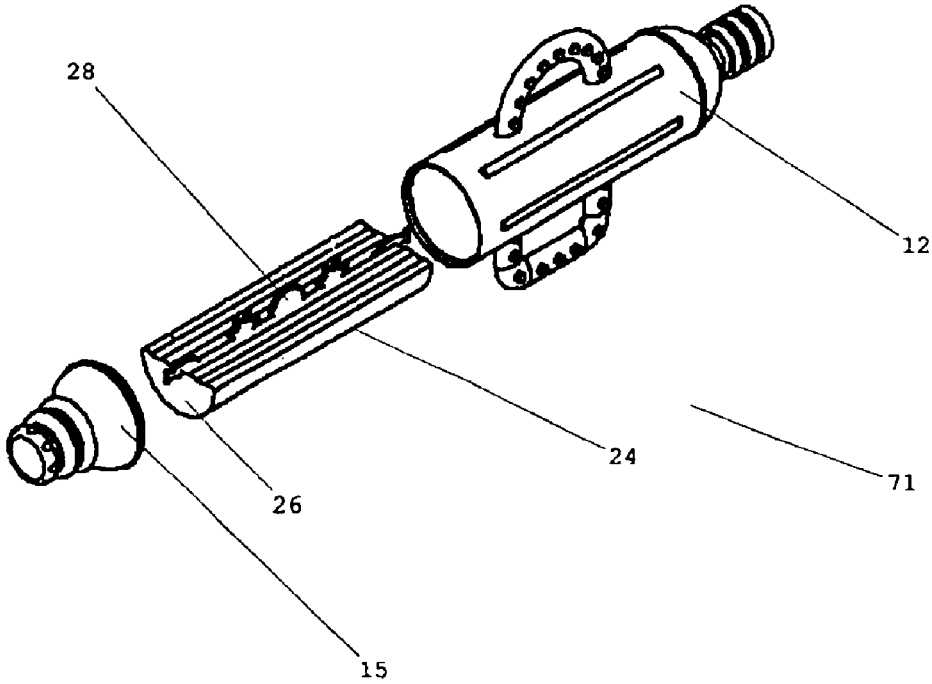
FIG. 2 is an exploded perspective view of a cavity base, internal components and end cap contained in the teething toy of FIG. 1.
Figure 8:
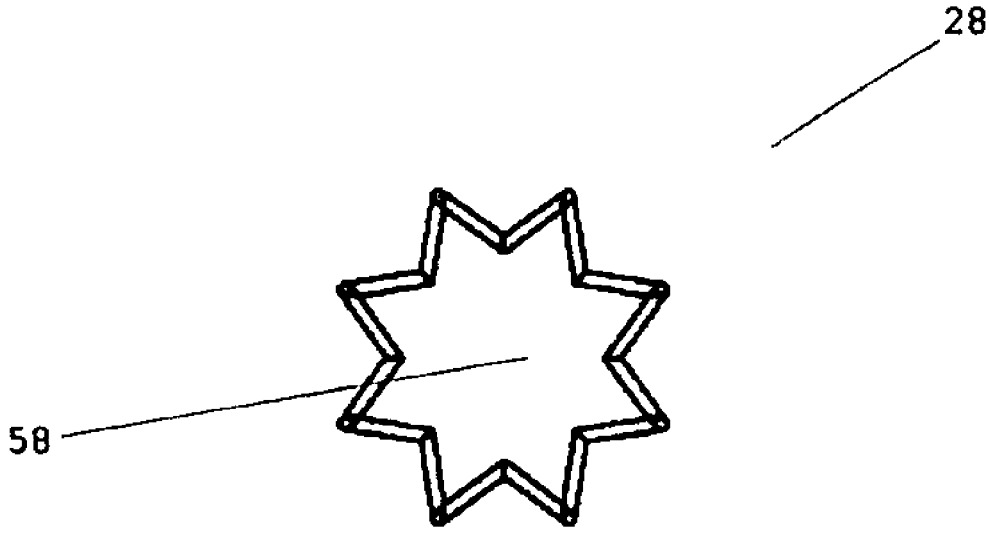
FIG. 8 is a front view of a star shaped floating element.
Figure 9:
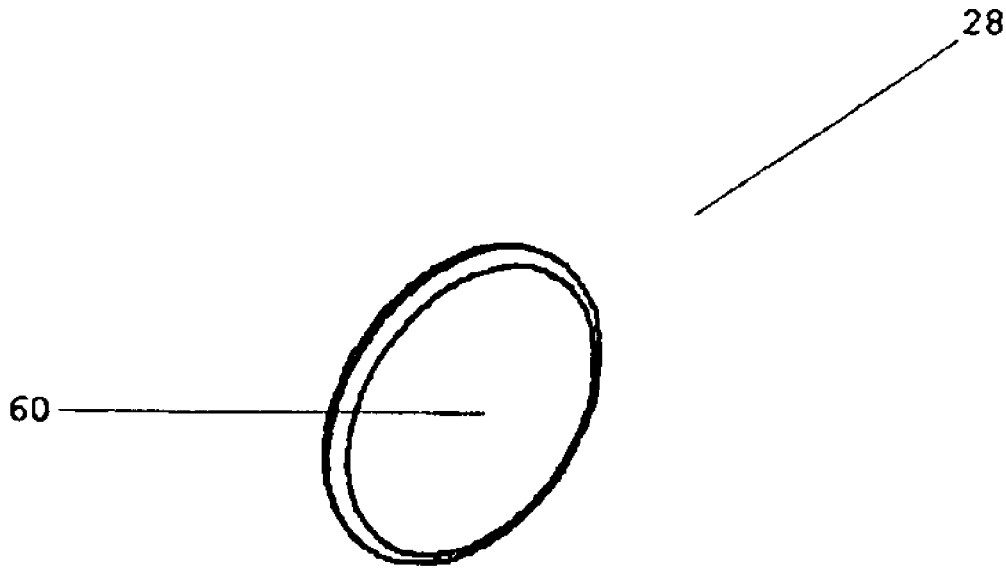
FIG. 9 is a perspective view of a disk shaped floating element.
Figure 10:
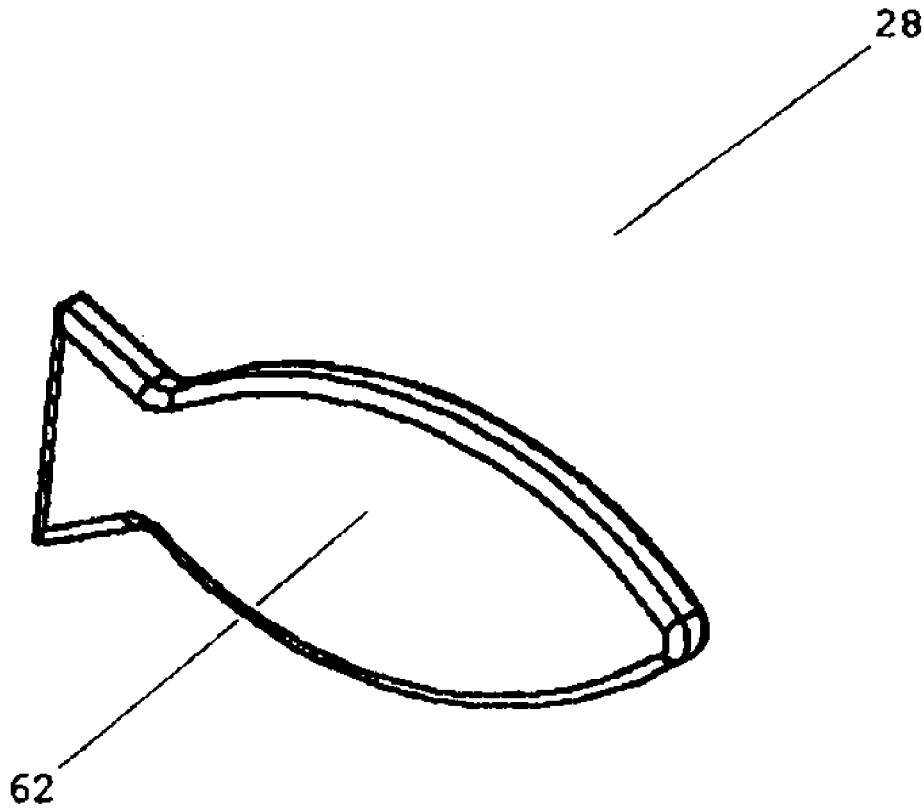
FIG. 10 is a perspective view of a fish shaped floating element.

As best seen in FIG. 2, a separate end cap 15 provides a method to close and seal cavity base 12. A fluid 24 partially fills cavity base 12 and can be seen through the clear polymeric material that makes up cavity base 12. Shiny particles are floating in the fluid 24 that are reflective in nature. The preferred embodiment has random size shiny particle 26 specks. However, the shiny particles could be uniform size without detracting from the present invention. There is also a set of floating objects 28 interspersed in the liquid. The floating objects 28 are buoyant and float to the surface of. the fluid 24. Referring to FIG. 8, FIG. 9 and FIG. 10, the floating objects 28 are shown as a star 58, a disk 60 and a fish 62. The preferred embodiment has these objects with differing sizes and colors: the star 58 is a red color, has eight points and measures approximately ¾" from point to point and is ⅛ inch thick: the disk 60 is yellow and measures approximately ⅞ inches in diameter and 3/16 inches thick: the fish 62 is green and measures approximately 1 inch in length, ¼ inch wide and ⅛ inch thick. However, the color, size and shape of the floating objects 28 could be varied without departing from the spirit and scope of the invention.

Figure 7:
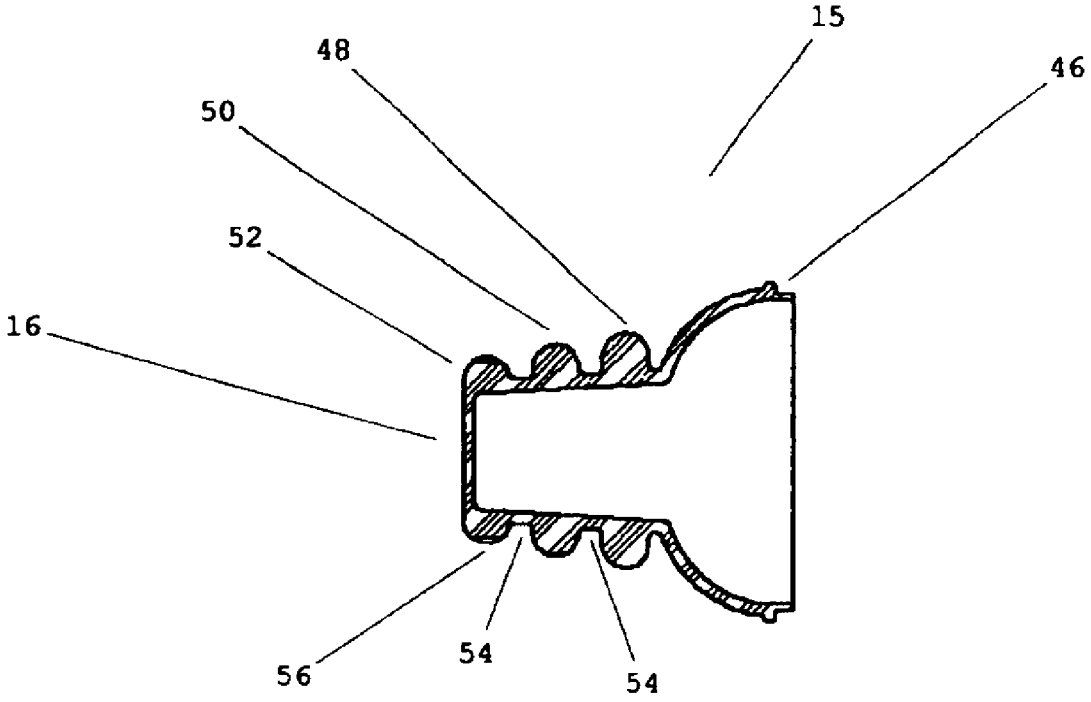
FIG. 7 is a right sectional view of an end cap of the teething toy of FIG. 1.

Referring to FIG. 2 and FIG. 7, end cap 15 has a series of rings defined as end roll minor 16. The purpose of end roll minor 16 is to provide a series of different size rolled rings to bite on. Circular edge roll one 48 is situated closest to the spherical shape of end cap 15. Circular edge roll two 50 is situated in the middle of end roll minor 16. Circular edge roll three 52 is on the outside end of end cap 15. The edge rolls are separated by circular edge groove 54. The preferred embodiment has a 1¼ inch diameter circular edge roll one 48 with a circular roll radius of ⅛ inches: a 1⅛ inch diameter circular edge roll two 50 with a roll radius of ⅛ inches: a 1 inch diameter circular edge roll three 52 with a roll radius of ⅛ inches. Circular edge roll three 52 has a series of circular roll cut 56 relief's placed around the periphery of the radius. The axis of curvature of each roll cut 56 runs parallel to the axis of curvature of cavity base 12. The preferred embodiment has eight roll cut 56 relief's equally spaced around the outer perimeter of circular edge roll three 52 with a radius of curvature of ⅛ inch and depth of 1/16 inch. However, the size and location of the edge rolls and roll cuts could be modified without departing from the scope of the invention As best seen in FIG. 6 and FIG. 7, end cap 15 has a sealing edge 46 on the outer spherical perimeter of the cap. The sealing edge 46 of end cap 15 mates to the sealing lip 44 found on cavity base 12. A suitable joining method seals end cap 15 to cavity base 12 after insertion of fluid 24, shiny particles and floating objects 28. Joining methods include adhesives, sonic welding or other suitable methods.

Figure 11:
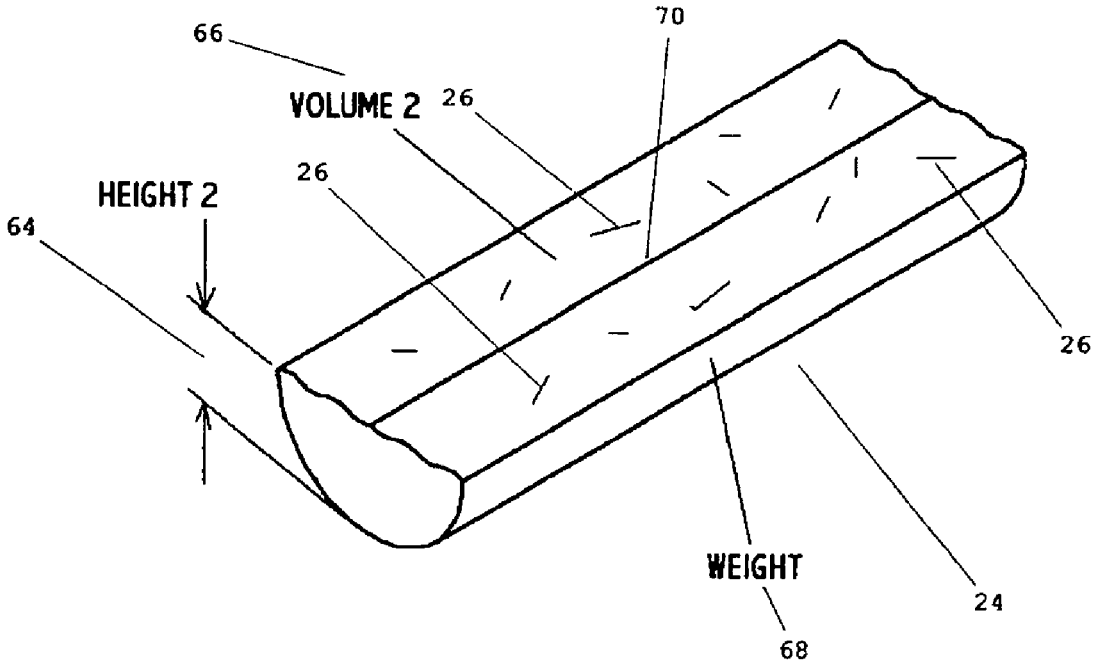
FIG. 11 is a perspective view of a colored liquid that partially fills the cavity of the present invention.

Referring to FIG. 6 and FIG. 11, cavity base 12 has an inner diameter designated as cavity base height 45 that is a defining characteristic of the inner volume of cavity base 12. The cavity base volume 41 allows insertion of fluid 24, shiny particles and floating objects 28. As best seen in FIG. 11, fluid height 64 is a defining characteristic of the volume of fluid 24 that is inserted into cavity base 12. The fluid volume 66 provides a movable weight 68 for teething toy 10. Shifting the orientation of teething toy 10 causes a transfer in the center of gravity 70 of fluid 24. A preferred embodiment provides cavity base height 45 of 1¾ inches and a cavity base volume 41 of 14 cubic inches with fluid height 64 of ⅞ inches and a fluid volume 66 of 7 cubic inches and weight 68 of 0.25 pounds of the fluid 24. This size and weight 68 closely approximates the characteristics of a typical infant feeding bottle that is approximately ½ filled. However, fluid height 64, fluid volume 66 and weight 68 could be modified without departing from the spirit and scope of the invention.

Figure 3:
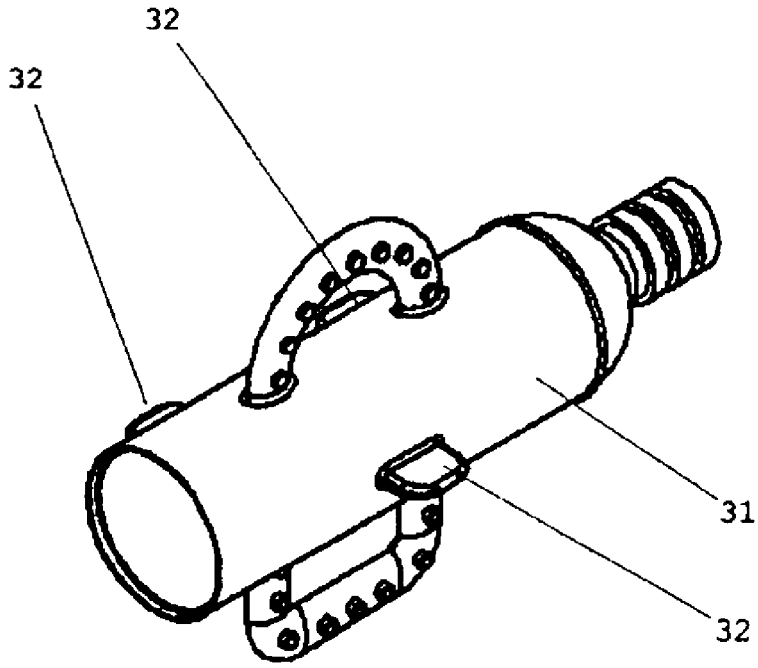
FIG. 3 is a perspective view of an alternate embodiment of the teething toy cavity of FIG. 1.
Figure 13:
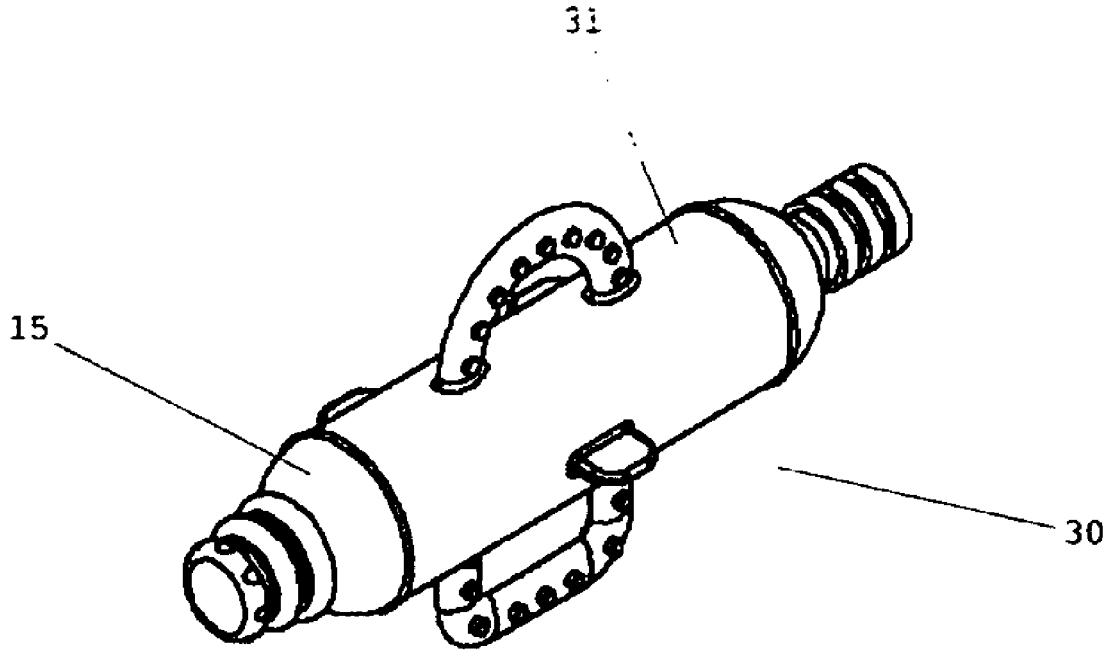
FIG. 13 is a perspective view of an alternate embodiment grip teething toy.

As best seen in FIG. 3 and FIG. 13, alternate embodiment grip teething toy 30 is comprised of grip cavity base 31 and end cap 15. A rectangular flange designated grip 32 protrudes from the side of grip cavity base 31 and is located in a position that is substantially 90 degrees from the circular ring handle 18 and in the center of grip cavity base 31. A second grip 32 is located in a position that is substantially 180 degrees from the first grip 32 and at ⅓ the length of grip cavity base 31. A third grip 32 is located in line with the second grip 32 and at ⅔ the length of grip cavity base 31. Alternate embodiment grip teething toy 30 contains fluid 24, shiny particle 26 species and floating objects 28 same as as teething toy 10. A preferred alternate embodiment grip teething toy 30 has the size of grip 32 at ¾ inches long by ½" wide by 3/16 inches thick with upper and lower edges that are angled at 4 degrees and ¼ inch radius corners and ⅛ inch filleted edges. However, the relative size and location of grip 32 could be modified without departing from the scope of the alternate embodiment grip teething toy 30.

Figure 4:
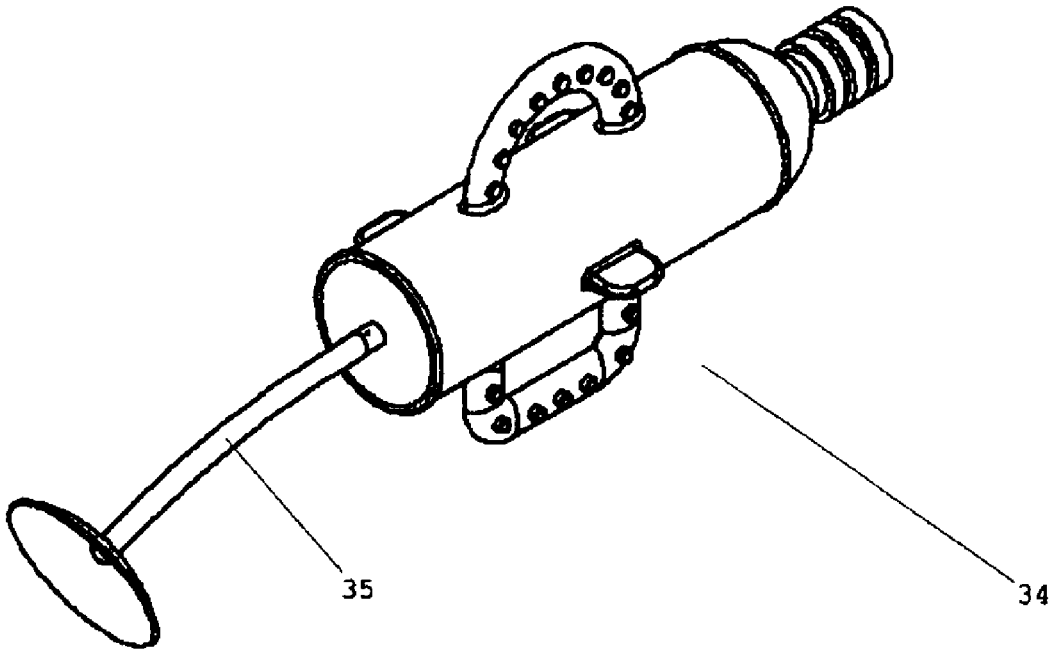
FIG. 4 is a perspective view of an alternate embodiment of the present invention with a suction cup tethering cord attached.
Figure 5:
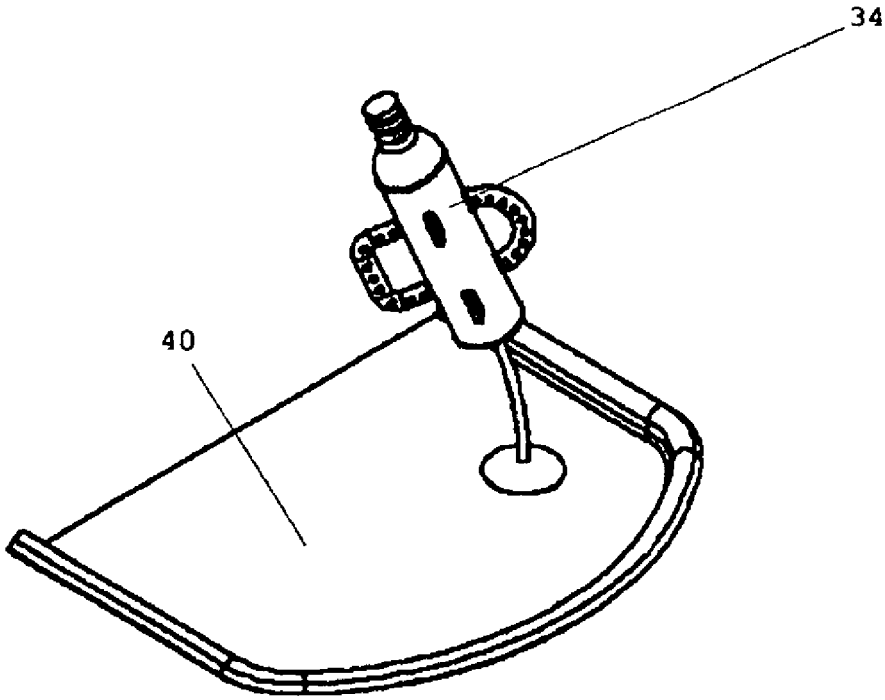
FIG. 5 is a perspective view of a teething toy of the present invention tethered to a high chair tray.
Figure 12:
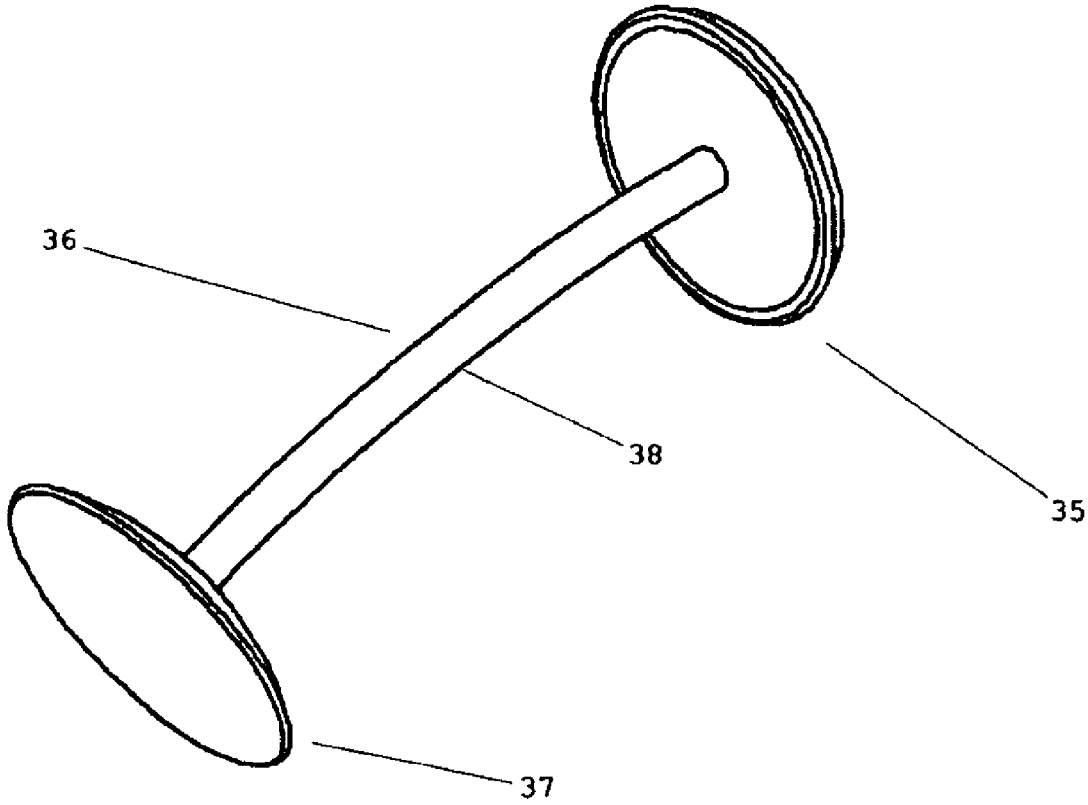
FIG. 12 is a perspective view of a suction cup tether end cap.

Referring to FIG. 4, alternate embodiment suction cup tethered teething toy 34 is comprised of grip cavity base 31 and suction cup tether end cap 35. As best seen in FIG. 12, suction cup tether end cap 35 is comprised of a flexible cord 38 and a suction cup 37. A distinguishing characteristic of flexible cord 38 is a flexibility property 36 that allows flexible cord 38 to flex and bend but also provide support for alternate embodiment suction cup tethered teething toy 34 to remain in an upright position. Flexibility property 36 provides a springing action that allows alternate embodiment suction cup tethered teething toy 34 to bounce and bob when moved. Referring to FIG. 5, alternate embodiment suction cup tethered teething toy 34 is shown attached to a representative tray 40 such as that found on a typical high chair. Alternate embodiment suction cup tethered teething toy 34 contains fluid 24, shiny particles and floating objects 28 same as teething toy 10.

Use of teething toy 10 by a child will now be described in detail. Referring to FIG. 1 and FIG. 2, Teething toy 10 is very similar in size and shape to a partially filled conventional feeding bottle. This similarity produces a natural interest and memory response 72 to teething toy 10. The child remembers previous enjoyable feeding and sucking events because of the natural feel and size of teething toy 10. The toy temperature 71 of teething toy 10 can be modified by warming or cooling the toy prior to use by the child similar to a feeding bottle. The fluid volume 66 of fluid 24 and weight 68 of fluid 24 provide natural comparison to previous encounters with a feeding bottle. During handling of teething toy 10 by the child, the movement of fluid 24 provides a noticeable change in the center of gravity 70 of fluid 24 providing a natural sensory stimulation to touch. Balancing teething toy 10 as the center of gravity 70 moves provides the opportunity for development of muscle coordination and motor skills. Prior art teething toys do not have this natural similarity to a feeding bottle and lack features that retain a child's interest. Lack of interest causes release of prior art teething toys and poor retention with ultimate child dissatisfaction and irritability.

In use, the toy is grasped by the fingers of the child around cavity base 12. The longitudinal rib 13 provides surface protrusions easy to hold onto. If the child is picking the teething toy 10 up, circular ring handle 18 or rectangular ring handle 22 can be easily reached and held onto with the oval cross section and knob 23 protrusions present on the handles. Circular ring handle 18 and rectangular ring handle 22 also provide narrow cross sections of teething toy 10 that fit easily into a small child's mouth for sucking or chewing on. The large number of knob 23 protrusions provides many areas for sensory stimulation of the child's gums, existing teeth and tongue. End ring major 14 on the end of cavity base 12 provides vertical edge ring 42 and vertical edge groove 43 areas with six distinct edges to bite and chew on. The distinct edges present on this end of teething toy 10 are ideal for aggressive chewing when a child is pushing teeth through its gum tissue. The separation of the rings provides Areas for gum tissue and/or teeth in the child's mouth to enter into.

On the opposite end of teething toy 10 as best seen in FIG. 2 and FIG. 7, end cap 15 provides end roll minor 16. This area of teething toy 10 is ideal for general sucking and tongue manipulation by the child. The cascading sizes of circular edge roll one 48, circular edge roll two 50 and circular edge roll three 52 allow for shallower or greater insertion of teething toy 10 into the child's mouth. The gentle radius' of the edge rolls also provides less aggressive areas to chew on when desired by the child. The roll cut 56 areas of circular edge roll three 52 provide additional sensory stimulation paths for oral gratification of the child. Prior art teething toys lack the varied types of edges and areas to chew and suck on as provided by the teachings of the present invention.

Sensory stimulation of the child is also provided by the visual characteristics of teething toy 10. As best seen in FIG. 2, a colored fluid 24 partially fills cavity base 12 and can be seen through the clear polymeric material that makes up cavity base 12. The colored fluid 24 provides contrast to the clear polymeric material of teething toy 10. Shiny particle 26 specks are floating in the fluid 24 that are reflective in nature to provide added contrast to the colored fluid 24. The floating objects 28 are buoyant and float to the surface of the fluid 24 providing additional visual stimulation. Referring to FIG. 8, FIG. 9 and FIG. 10, the floating objects 28 are shown as a star 58, a disk 60 and a fish 62 that are multicolored. The variety of colored fluid 24, shiny particle 26 specks and multicolored floating objects 28 add a kaleidoscope of color to teething toy 10 for visual stimulation of the child. Movement and splashing of fluid 24 inside cavity base 12 in concert with the movement of shiny particles and floating objects 28 provides visual stimulation by the nature of the movement of the fluid 24. Prior art teething toys lack the variety of color and movement of fluid 24, shiny particle 26 specks and floating objects 28 as provided by the present invention.

Referring to FIG. 3 and FIG. 13, use of alternate embodiment grip teething toy 30 is similar in nature to teething toy 10 with additional stimulation as provided by grip 32 protrusions found on the periphery of cavity base 12. The tapered rectangular cross sections of grip 32 provide narrow protrusions that are ideal for the child to chew and suck on. The staggered locations of grip 32 protrusions provides an asymmetrical appearance to alternate embodiment grip teething toy 30 to assist in retaining the child's interest in alternate embodiment grip teething toy 30. In combination with circular ring handle 18 and rectangular ring handle 22, alternate embodiment grip teething toy 30 offers a wide variety of gripping surfaces that provide convenient handles for the child to use for manipulation and movement of alternate embodiment grip teething toy 30. Prior art teething toys lack the large variation and location of gripping surfaces that result in poor retention of the toy by the child.

Use of alternate embodiment suction cup tethered teething toy 34 will now be described in detail. Referencing FIGS. 4 and 5, suction cup tether end cap 35 provides a convenient method to temporarily attach alternate embodiment suction cup tethered teething toy 34 to a suitable surface, such as a feeding tray 40. Suction cup tether end cap 35 provides an ideal method to retain alternate embodiment suction cup tethered teething toy 34 within the child's grasp and prevents throwing away of the toy. The flexibility property 36 of flexible cord 38 produces a bouncing and bobbing motion that induces the natural interest and curiosity of the child. The bouncing motion induces a periodic change in the center of gravity 70 of fluid 24 causing continued movement of the toy after it has been manipulated by the child. This characteristic aids in toy retention and overall enjoyment of the child during use of alternate embodiment suction cup tethered teething toy 34. Prior art teething toys lack suction cup tether end cap 35 that provides a temporary and movable securing feature as provided on alternate embodiment suction cup tethered teething toy 34.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims

What is claimed is:

1. A teething toy for satisfying a young child with oral stimulation, visual entertainment and motor skill development, comprising:

a cavity base for fluid and a holding surface that reminds the child of a feeding bottle;

a rounded gripping surface on the side of the cavity base working in combination with other ribs as an aid in holding the teething toy, rigidly molded to the cavity base and providing a cavity for fluid and a holding surface that reminds the child of a feeding bottle;

an end cap to seal the cavity base of the teething toy, centrally bonded to the cavity base and providing a cavity for fluid and a holding surface that reminds the child of a feeding bottle;

a contoured handle for the child to grasp and hold the teething toy and for chewing, sucking and sensory stimulation, integrally molded to the cavity base and providing a cavity for fluid and a holding surface that reminds the child of a feeding bottle;

a straight handle for the child to hold and grasp the teething toy and for oral and sensory stimulation, integrally molded to the cavity base and providing a cavity for fluid and a holding surface that reminds the child of a feeding bottle;

a grasping aid with other knobs on the sides of the circular ring handle and the rectangular ring handle and for providing touch stimulation to the fingers, lips, tongue and gums;

a medium with a moving center of gravity to stimulate motor skills and for providing a familiar memory response to feeding and for providing a medium for shining particles and floating objects, entirely inserted into the cavity base and providing a cavity for fluid and a holding surface that reminds the child of a feeding bottle;

a reflective particle(s) with other shining particles for visual stimulation of the child, fully inserted into the fluid and providing a medium with a moving center of gravity to stimulate motor skills and for providing a familiar memory response to feeding and for providing a medium for shining particles and floating objects;

a cavity base for fluid with additional handles for ease of manipulation and providing smaller chewing surfaces for teething;

a smaller teething flange for the child to bite on and for providing additional handles to manipulate the toy, integrally molded to the cavity base and providing a cavity for fluid with additional handles for ease of manipulation and providing smaller chewing surfaces for teething;

a curved lid to seal the inner cavity of the teething toy that has a flexible tether cord and suction cup attached;

a flexible membrane for temporary fastening of the tether cord to a surface;

a vertical shoulder to bite on, integrally molded to the cavity base and providing a cavity for fluid and a holding surface that reminds the child of a feeding bottle;

a grooved area for gums and teeth to bite into, integrally molded to the cavity base and for providing a cavity for fluid and a holding surface that reminds the child of a feeding bottle;

a female sealing edge on the cavity base for the end cap to bond to, integrally molded to the cavity base and providing a cavity for fluid and a holding surface that reminds the child of a feeding bottle;

a cavity base height 1 that is larger than fluid height 2;

a male seal edge to bond the end cap to the cavity base, integrally molded to the end cap for providing a curved lid to seal the inner cavity of the teething toy;

a rolled ring of larger diameter for tongue stimulation and sucking enjoyment, integrally molded to the end cap for providing a curved lid to seal the inner cavity of the teething toy;

a rolled ring of intermediate diameter for tongue stimulation and sucking enjoyment, integrally molded to the end cap for providing a curved lid to seal the inner cavity of the teething toy;

a rolled ring of smaller diameter for tongue stimulation and sucking enjoyment, integrally molded to the end cap for providing a curved lid to seal the inner cavity of the teething toy;

a rounded groove for a gentle biting surface, integrally molded to the end cap for providing a curved lid to seal the inner cavity of the teething toy;

an uneven surface on circular edge groove three for chewing, biting and sucking, integrally molded to the end cap for providing a rolled ring of smaller diameter for tongue stimulation and sucking enjoyment;

a star shaped floating object, generally inserted to the fluid for providing a medium with a moving center of gravity to stimulate motor skills and for providing a familiar memory response to feeding and for providing a medium for shining particles and floating objects;

a disk shaped floating object, generally inserted to the fluid for providing a medium with a moving center of gravity to stimulate motor skills and for providing a familiar memory response to feeding and for providing a medium for shining particles and floating objects;

a fish shaped floating object, generally inserted to the fluid for providing a medium with a moving center of gravity to stimulate motor skills and for providing a medium for shining particles and floating objects;

a fluid height 2 that is less than cavity base height 1; and an elastic support member that attaches the suction cup to the suction cup tethered end cap, axially anchored to the suction cup tether end cap for providing a flexible membrane for temporary fastening of the tether cord to a surface, and integrally molded to the suction cup tether end cap for providing a curved lid to seal the inner cavity of the teething toy that has a flexible tether cord and suction cup attached.

2. The teething toy in accordance with claim 1, wherein a cavity for fluid and a holding surface that reminds the child of a feeding bottle comprises a hollow cavity base.

3. The teething toy in accordance with claim 1, wherein a rounded gripping surface on the side of the cavity base working in combination with other ribs as an aid in holding the teething toy comprises a longitudinal rib.

4. The teething toy in accordance with claim 1, wherein a curved lid to seal the inner cavity of the teething toy comprises a spherical end cap.

5. The teething toy in accordance with claim 1, wherein a contoured handle for the child to grasp and hold the teething toy and for chewing, sucking and sensory stimulation comprises a rounded circular ring handle.

6. The teething toy in accordance with claim 1, wherein a straight handle for the child to hold and grasp the teething toy and for oral and sensory stimulation comprises a three sided rectangular ring handle.

7. The teething toy in accordance with claim 1, wherein a grasping aid with other knobs on the sides of the circular ring handle and the rectangular ring handle and for providing touch stimulation to the fingers, lips tongue and gums comprises an extension knob.

8. The teething toy in accordance with claim 1, wherein a medium with a moving center of gravity to stimulate motor skills and for providing a familiar memory response to feeding and for providing a medium for shining particles and floating objects comprises a liquid fluid.

9. The teething toy in accordance with claim 1, wherein a reflective particle with other shiny particles for visual stimulation of the child comprises a reflective shiny particle.

10. The teething toy in accordance with claim 1, wherein a cavity for fluid with additional handles for ease of manipulation and providing smaller chewing surfaces for teething comprises a hollow grip cavity base.

11. The teething toy in accordance with claim 1, wherein a smaller teething flange for the child to bite on and for providing additional handles to manipulate the toy comprises a grip.

12. The teething toy in accordance with claim 1, where a curved lid to seal the inner cavity of the teething toy that has a flexible tether cord and suction cup attached comprises a spherical suction cup tether end cap.

13. The teething toy in accordance with claim 1, where a flexible membrane for temporary fastening of the tether cord to a surface comprises a suction cup.

14. The teething toy in accordance with claim 1, where a vertical shoulder to bite on comprises a circular vertical edge ring.

15. The teething toy in accordance with claim 1, where a grooved area for gums and teeth to bite into comprises a channel shape vertical edge groove.

16. The teething toy in accordance with claim 1, where a female sealing edge on the cavity base for the end cap to bond to comprise a circular, bore sealing lip.

17. The teething toy in accordance with claim 1, where a cavity base height 1 that is larger than fluid height 2 comprises a diametrical cavity base height.

18. The teething toy in accordance with claim 1, where a male seal edge to bond the end cap to the cavity base comprises a circular, extension sealing edge.

19. The teething toy in accordance with claim 1, where a rolled ring of larger diameter for tongue stimulation and sucking enjoyment comprises a radiused circular edge roll one.

20. The teething toy in accordance with claim 1, where a rolled ring of intermediate diameter for tongue stimulation and sucking enjoyment comprises a radiused circular edge roll two.

21. The teething toy in accordance with claim 1, where a rolled ring of smaller diameter for tongue stimulation and sucking enjoyment comprises a radiused circular edge roll three.

22. The teething toy in accordance with claim 1, where a rounded groove for a gentle biting surface comprises a radiused circular edge groove.

23. The teething toy in accordance with claim 1, where an uneven surface on circular edge groove three for chewing, biting and sucking comprises a distinct edge roll cut.

24. The teething toy in accordance with claim 1, where a star shaped floating object comprises a colorful, buoyant star.

25. The teething toy in accordance with claim 1, where a disk shaped floating object comprises a colorful, buoyant disk.

26. The teething toy in accordance with claim 1, where a fish shaped floating object comprises a colorful, buoyant fish.

27. The teething toy in accordance with claim 1, where a fluid height 2 that is less than cavity height 1 comprises a visible fluid height.

28. The teething toy in accordance with claim 1, where an elastic support member that attaches the suction cup to the suction cup tethered end cap comprises a pliable, supportive flexible cord.

29. A teething toy for satisfying a young child with oral stimulation, visual entertainment and motor skill development, comprising:

a hollow cavity base, for providing a cavity for fluid and a holding surface that reminds the child of a feeding bottle a longitudinal rib, for providing a rounded gripping surface on the side of the cavity base working in combination with other ribs as and aid in holding the teething toy, rigidly molded to the cavity base;

a spherical end cap, for providing a curved lid to seal the inner cavity of the teething toy, centrally bonded to the cavity base;

a rounded circular ring handle, for providing a contoured handle for the child to grasp and hold the teething toy and for chewing, sucking and sensory stimulation, integrally molded to the cavity base;

a three sided rectangular ring handle, for providing a straight handle for the child to hold and grasp the teething toy and for oral and sensory stimulation, integrally molded to the cavity base;

an extension knob, for providing a grasping aid with other knobs on the sides of the circular ring handle and the rectangular ring handle and for providing touch stimulation to the fingers, lips tongue and gums;

a liquid fluid, for providing a medium with a moving center of gravity to stimulate motor skills and for providing a familiar memory response to feeding and for providing a medium for shining particles and floating objects, entirely inserted to the cavity base;

a reflective shiny particle, for providing light reflection with other shiny particles for visual stimulation of the child, fully inserted to the fluid;

a hollow grip cavity base, for providing a cavity for fluid with additional handles for ease of manipulation and providing smaller chewing surfaces for teething;

a grip, for providing a smaller teething flange for the child to bite on and for providing additional handles to manipulate the toy, integrally molded to the grip cavity base;

a spherical suction cup tether end cap, for providing a curved lid to seal the inner cavity of the teething toy that has a flexible tether cord and suction cup attached;

a suction cup, for providing a flexible membrane for temporary fastening of the tether cord to a surface;

a circular vertical edge ring, for providing a vertical shoulder to bite on, integrally molded to the cavity base;

a channel shape vertical edge groove, for providing a grooved area for gums and teeth to bite into, integrally molded to the cavity base;

a circular, bore sealing lip, for providing a female sealing edge on the cavity base for the end cap to bond to, internally molded to the cavity base;

a diametrical cavity base height, for providing a cavity base height 1 that is larger than fluid height 2;

a circular, extension sealing edge, for providing a male seal edge to bond the end cap to the cavity base, integrally molded to the end cap;

a radiused circular edge roll one, for providing a rolled ring of larger diameter for tongue stimulation and sucking enjoyment, integrally molded to the end cap;

a radiused circular edge roll two, for providing a rolled ring of intermediate diameter for tongue stimulation and sucking enjoyment, integrally molded to the end cap;

a radiused circular edge roll three, for providing a rolled ring of smaller diameter for tongue stimulation and sucking enjoyment, integrally molded to the end cap;

a radiused circular edge groove, for providing a rounded groove for a gentle biting surface, integrally molded to the end cap;

a distinct edge roll cut, for providing and uneven surface on circular edge groove three for chewing, biting and sucking, integrally molded to the circular edge roll three;

a colorful, buoyant star, for providing a star shaped floating object, generally inserted to the fluid;

a colorful, buoyant disk, for providing a disk shaped floating object, generally inserted to the fluid;

a colorful, buoyant fish, for providing a fish shaped floating object, generally inserted to the fluid;

a visible fluid height, for providing a fluid height 2 that is less than cavity base height 1; and a pliable, supportive flexible cord, for providing an elastic support member that attaches the suction cup to the suction cup tethered end cap, axially anchored to the suction cup, and integrally molded to the suction cup tether cap.

* * * * *